US005622490A

United States Patent [19]

Cheng

[11] Patent Number: 5,622,490

[45] Date of Patent: Apr. 22, 1997

[54] CANDLE HOLDER

[76] Inventor: Chak Y. Cheng, 15th Floor, Flats B&D, E Wah Factory Building 56-60 Wong Chuk Hang Road, Aberdeen, Hong Kong

[21] Appl. No.: 472,524

[22] Filed: Jun. 7, 1995

[30] Foreign Application Priority Data

Mar. 7, 1995 [GB] United Kingdom ..... 9504546

[51] Int. Cl.[6] ..... F23D 3/16

[52] U.S. Cl. ..... 431/288; 431/125

[58] Field of Search ..... 431/288, 296, 431/297, 291, 125

[56] References Cited

U.S. PATENT DOCUMENTS

| | | | |
|---|---|---|---|
| 3,890,085 | 6/1975 | Andeweg | 431/291 X |
| 4,477,249 | 10/1984 | Ruzek et al. | 431/253 |
| 4,801,478 | 1/1989 | Greenblatt . | |
| 4,895,512 | 1/1990 | Sullivan et al. | 431/296 X |
| 4,983,119 | 1/1991 | Lin | 431/288 X |

FOREIGN PATENT DOCUMENTS

| | | | |
|---|---|---|---|
| 18177 | of 1915 | United Kingdom | 431/297 |
| 2230888 | 10/1990 | United Kingdom . | |

*Primary Examiner*—Larry Jones
*Attorney, Agent, or Firm*—Gunn, Lee & Miller, P.C.

[57] ABSTRACT

A musical candle holder has a body. A cylindrical plug frictionally fits inside the body and supports a loudspeaker and a printed circuit board. A battery and a melody chip are mounted on the board. Exposed conductors (not shown) are shorted by a slider when required and provides a switch to turn on the chip.

The slider has a finger which extends out of the bottom of the body to allow manual operation of the switch.

4 Claims, 1 Drawing Sheet

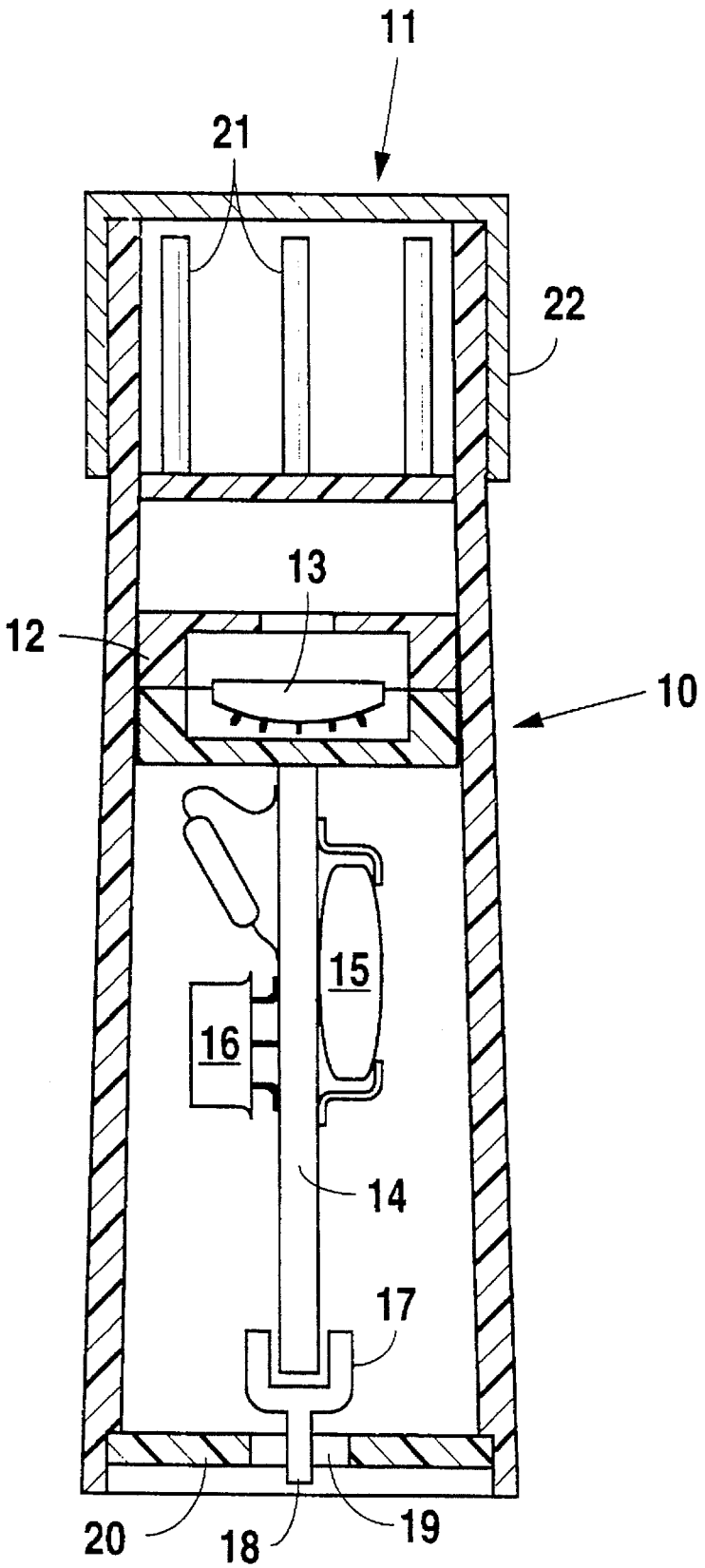
11
21
22
13
12
10
15
16
14
17
20
18
19

CANDLE HOLDER

BACKGROUND OF THE INVENTION

1. Field of Invention

The invention relates to candle holders.

2. Description of the Prior Art

The invention relates more particularly to musical candle holders. Such candle holders have already been proposed which include melody chips and which are switched on by heat generated by the candle when lit.

SUMMARY OF THE INVENTION

It is an object of the present invention to provide a reusable musical candle holder which is a manually operated to turn on and off.

According to the invention, there is provided a musical candle holder comprising a cylindrical plastics body having cup shaped opening at one end to receive and fit around a base of a candle, a melody chip, a loudspeaker, a printed circuit board and battery mounted inside the body, and a manually operable electrical switch.

The cup-shaped opening is preferably integrally formed with radially extending ribs on its inside peripheral surface to indent and grip the lower outer surface of a candle.

The loudspeaker may be mounted on a cylindrical plug which frictionally fits inside and adjacent one end of the body.

The printed circuit board may be mounted on the plug and extends down the body and generally across a diameter of the body.

The printed circuit body may have a pair of exposed conductors at one end, and the switch comprise a slider which fits over the end of the printed circuit board which is movable to short across the conductors to turn on the melody chip.

BRIEF DESCRIPTION OF THE DRAWING

A musical candle holder according to the invention will now be described by way of example with reference to the accompanying sectional elevation of the holder.

DESCRIPTION OF THE PREFERRED EMBODIMENT

Referring to the drawing, the candle holder comprises a slightly tapered cylindrical plastics body 10 with a cup-shaped opening 11 at one end. A cylindrical plug 12 is a frictional fit inside the body 10 as shown and supports a loudspeaker 13 and a printed circuit board 14. The printed circuit board extends down the body and is mounted across a diameter of the body 10. The printed circuit board 14 supports a battery 15 and a melody chip 16. Exposed conductors (not shown) on the circuit board 14 are mounted at the lower end of the board 14 and are shorted together by a conductor on a slider 17 as required to turn on and off the melody chip manually. The slider has a finger 18 which extends through a slot 19 in a bottom cap 20.

The end 11 is formed with inwardly projecting ribs 21 which indent and grip the bottom of a candle when it is pushed into the end 11. A metal cap 22 fits over the end 11 to protect the body 10 from radiant heat generated by the candle when it burns down.

In use, the candle holders support a candle on a firm flat surface and are re-usable. The candle holders provide music, traditionally such tunes as "Happy Birthday", or a "Wedding March" as preferred, and according to the musical chip selected. It is usually possible to remove the components from the body 10, as the parts are simply press-fitted together, to change the chip or more normally simply to insert a new battery. It is also possible to fit or provide the base of the holder with a stake or probe which fits into and holds the body 10 in the top of a cake or the like.

I claim:

1. A musical candle holder comprising a cylindrical plastics body having cup-shaped opening at one end to receive and releasably fit around a base of a candle; and an interchangeable melody chip, electrically connectable to a loudspeaker, a printed circuit board, a battery, and an externally accessible manually operable electrical switch, all mounted inside said body on a removable cylindrical plug frictionally fit inside said body.

2. A holder according to claim 1, in which said cup-shaped opening is integrally formed with radially extending ribs on an inside peripheral surface to indent and grip said lower outer surface of said candle.

3. A holder according to claim 1 wherein said printed circuit board extends downwardly in said body and generally across a diameter of said body.

4. A holder according to claim 1 wherein said printed circuit body has a pair of exposed conductors at one end, and said switch comprises a slider fit over an end of said printed circuit board movable to electrically connect said conductors to turn on said melody chip.

* * * * *